United States Patent [19]

Weidenhagen et al.

[11] 4,290,364

[45] Sep. 22, 1981

[54] GUIDED BOMB FOR USE IN LOW LEVEL FLYING

[75] Inventors: Dieter Weidenhagen, Neubiberg; Werner Schnaebele, Wolfratshausen, both of Fed. Rep. of Germany

[73] Assignee: Messerschmitt-Bölkow-Blohm G.m.b.H., Fed. Rep. of Germany

[21] Appl. No.: 6,213

[22] Filed: Jan. 24, 1979

[30] Foreign Application Priority Data

Jan. 24, 1978 [DE] Fed. Rep. of Germany ..... 2803036

[51] Int. Cl.[3] ..... F42B 25/24

[52] U.S. Cl. ..... 102/384; 358/103; 358/109; 250/333

[58] Field of Search ..... 102/3, 4; 244/3.1, 3.11, 244/3.12, 3.13, 3.14

[56] References Cited

U.S. PATENT DOCUMENTS

| | | | |
|---|---|---|---|
| 2,539,643 | 1/1951 | Smythe | 102/4 |
| 2,649,262 | 8/1953 | Fahrney | 244/3.14 |
| 2,680,578 | 6/1954 | Katz | 102/3 |
| 2,704,513 | 3/1955 | Dane, Jr. | 102/3 |
| 2,792,190 | 5/1957 | Seibold | 244/3.11 |
| 2,825,021 | 2/1958 | Friend | 102/3 |
| 2,924,652 | 2/1960 | Kramskoy | 244/3.14 |
| 3,047,259 | 7/1962 | Tatnall et al. | 102/4 |
| 3,749,017 | 7/1973 | Peterson | 102/4 |

*Primary Examiner*—Charles T. Jordan
*Attorney, Agent, or Firm*—McGlew and Tuttle

[57] ABSTRACT

A guided bomb for use in low level flying for pinpoint target combat, comprises a bomb having a braking device associated therewith to produce a slow-down which is effective against the trajectory and a picture-taking sensor connected to the bomb to guide the bomb for final phase guidance. The braking device advantageously comprises retrorockets or a parachute. The picture-taking sensor is advantageously a television camera or an infrared camera and a tracker is associated with it which may be mounted, for example, on the aircraft carrying the bomb. The picture taken by the picture-taking sensor is transmitted via either a radio or mechanical connection to the aircraft and is reproduced there for guidance by the pilot. The target may advantageously be illuminated by a laser illuminator carried on the aircraft and the bomb advantageously has a tracker with laser vectoring.

2 Claims, 6 Drawing Figures

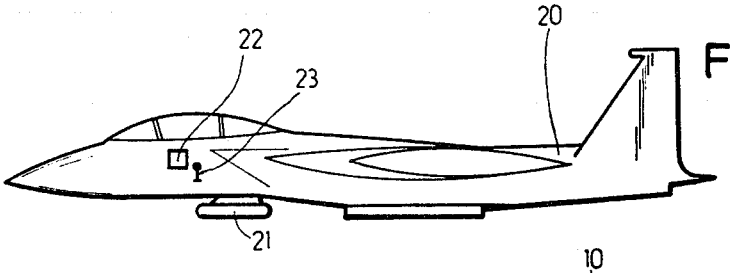
Fig.1c
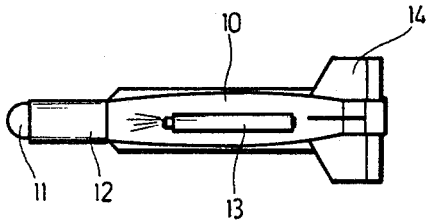
Fig.1b
Fig.2c
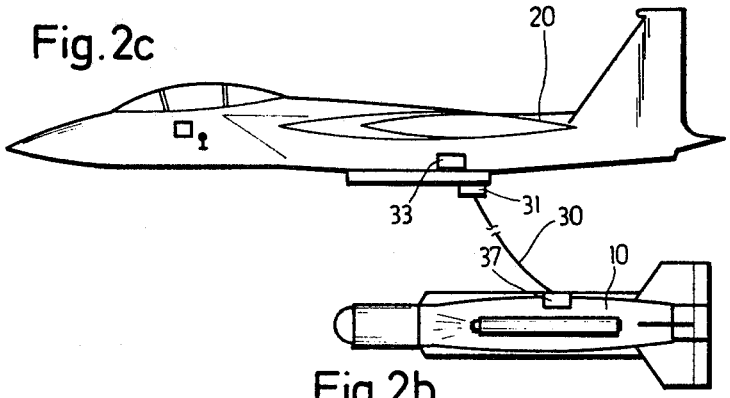
Fig.2b

GUIDED BOMB FOR USE IN LOW LEVEL FLYING

FIELD AND BACKGROUND OF THE INVENTION

This invention relates to aerial bombs in general and, in particular, to a new and useful guided bomb for use in low level flying for pinpoint target combat.

DESCRIPTION OF THE PRIOR ART

Pinpoint target combat with bombs dropped from aircarft entails a number of problems concerning both the survival of the aircraft and the efficiency of the deployment of the bomb.

A method for ground target combat is known from German Pat. No. 1,267,100 which supposedly increases the survival probability of an aircraft crew and the aircraft efficiency in air-ground deployment to a maximum. The essential feature of this method is the utilization of the kinetic energy of the dropped bomb for the generation of aerodynamic lifting power so that, overall, a trajectory of the dropped bomb opposed to the flight direction of the aircraft is obtained. Among others, remote guidance from the carrier aircraft into the target is provided for the final phase.

The method is to ensure that the target can be approached and overflown at the greatest possible speed so as to minimize the effectiveness of possible anti-aircraft defenses right from the start. By the same token, the danger that the aircraft itself may be hit by splinters is almost completely eliminated. However, the technical cost for the realization of this method is considerable. The droppable unit must be installed on the top of the aircraft which causes access problems during assembly. The release mechanism must assure that the droppable unit cannot damage the rear portion of the aircraft after its release. Finally, the droppable unit must have excellent aerodynamic properties so that the required trajectory can indeed be prescribed without tumbling or flow breakaway or other altitudes which might jeopardize the success of the mission.

A method which essentially only increases the efficiency of the bomb deployment, provides for remote guidance of the bomb through a television camera. The video picture is transmitted to a flight indicator. A crew member guides the bomb into the target via radio signals according to the picture and to a prepared reticule on the picture screen. (See also U.S. Pat. No. 2,680,578.)

While this well-known method leads to extreme aiming precision and great hitting accuracy, it requires that the aircraft fly relatively high, thus exposing it to possible antiaircraft defenses to an extent which reduces the survival probability of the aircraft intolerably.

Finally, it is known from German Disclosure DE-OS No. 1,912,616 to slow down a bomb after its release from the aircraft by means of a parachute connected to the bomb. In addition, a nozzle block is provided whose nozzles are arranged so that, after the release of the bomb, the discharging gases reduce the kinetic energy of the free-flying bomb. However, while this measure permits dropping the bomb in low level flight of the aircraft and at are very high speeds so that the success chances of antiaircraft defenses are reduced, the hitting characteristics are unsatisfactory.

Other measures, such as the remote guidance of the bomb via a wire connecting bomb and aircraft, or also via radio are also known for solving the indicated problem. (See U.S. Pat. No. 2,649,262.)

Moreover, a method has been described in the German Provisional Patent DE-AS No. 2,411,791 for combatting ground targets by means of guided missiles which works with a picture-taking device provided on the missile, from where the pictorial information of the target area is transmitted to the firing base to be used there for the correct guidance of the missile. The missile is first shot into a ballistic trajectory. The picture is picked up in the vicinity of the target and the missile is guided in such a manner that the missile is slowed down during the descending part of the trajectory and the probable point of impact of the missile is marked by illumination from the missile. A laser or similar device is used for illumination. A signal transmission line between the missile and the firing base is also provided.

The method and the equipment for the method serve the employment of ground-to-ground missiles and are supposed to make it possible to combat effectively objects located behind terrain formations.

SUMMARY OF THE INVENTION

An object of the present invention is to provide a guided bomb for use in low level flight for pinpoint target combat, which incorporates the advantages achievable by the known individual measures, such as the safety of the aircraft and the hitting accuracy of the bomb, without loss of the optimum achievable with the known individual measures. This problem is solved by providing the bomb with a braking device to produce a slow-down effective against the trajectory, and a picture-taking sensor for final phase guidance.

None of the known individual measures is capable of solving the problem posed. It is only through the combination of guiding the bombs precisely into the target in high-speed, low level flight, whereby the number of approaches and thus the endangerment of the aircraft are greatly reduced without giving up the protection which low level flight offers.

Accordingly, it is an object of the present invention to provide a guided bomb for use in low level flying for pinpoint target combat which comprises a bomb body, a braking device mounted on the body to produce a slow-down effective against the trajectory of the body and a picture-taking sensor mounted on the bomb body connected to the controls thereof for final phase guidance thereof.

A further object of the invention is to provide a guided bomb for use in low level flying which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawing and descriptive matter in which preferred embodiments of the invention are illustrated.

BRIEF DESCRIPTION OF THE DRAWINGS

In the Drawings:

FIG. 1*c* is a side elevational view of an aircraft associated with the bomb constructed in accordance with the invention;

FIG. 1*b* is a top plan view of the bomb constructed in accordance with the invention;

FIGS. 2*c* and 2*b* are views similar to FIGS. 1*c* and 1*b* for the embodiment described in FIG. 2*a*.

DESCRIPTION OF THE PREFERRED EMBODIMENTS

Figure 1A:
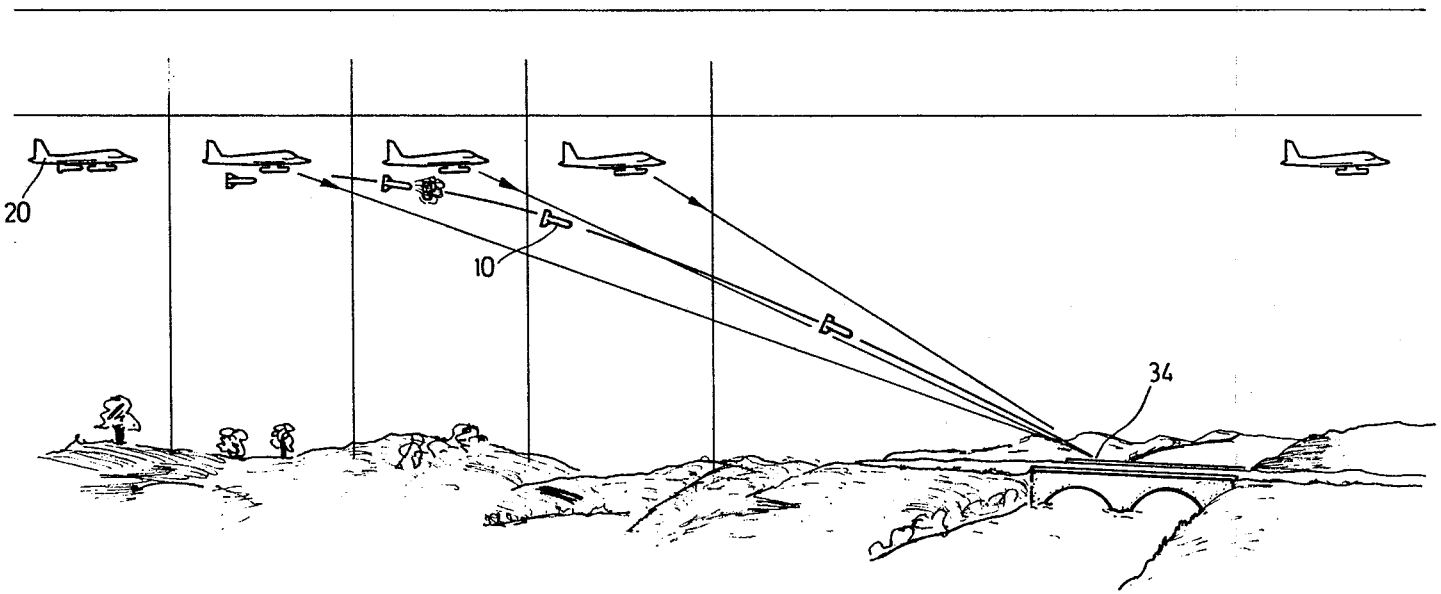
FIG. 1*a* is a chart diagram indicating an aircraft approach with a bomb, constructed in accordance with the invention.

Referring to the drawings in particular, the invention embodied therein, as shown in FIG. 1*a*, comprises a bomb 10, equipped with a television camera 11 and a tracker with laser vectoring 12, retrorockets 13 and wing/rudder 14. FIG. 1*c* shows an aircraft 20 with a laser illuminator 21, television camera 22 and a steering lever 23 coupled to the laser illuminator.

Guiding the bomb 10 now proceeds as follows, according to FIG. 1*a*: The aircraft moves at high speed and at an altitude of 50 to 150 m above ground. A target 34 (not shown) is picked up in the acquisition phase. The laser illuminator is directed at the target and is kept on it and the bomb is dropped. In the next phase, the retrorockets are ignited so that the desired slow-down of the bomb occurs. Another suitable braking device such as droppable parachutes may be used instead of retrorockets. The laser illuminator 21 illuminates the target 34 until shortly before the overflight. During the illuminated phase, the bomb steers automatically towards the illuminated spot and, at the same time, the television camera hooks onto the target. Starting with the end of the illuminated phase, the bomb approaches the target autonomously by means of the video tracker 12. It goes without saying that the tracker 12 may also be used alone.

Figure 2A:
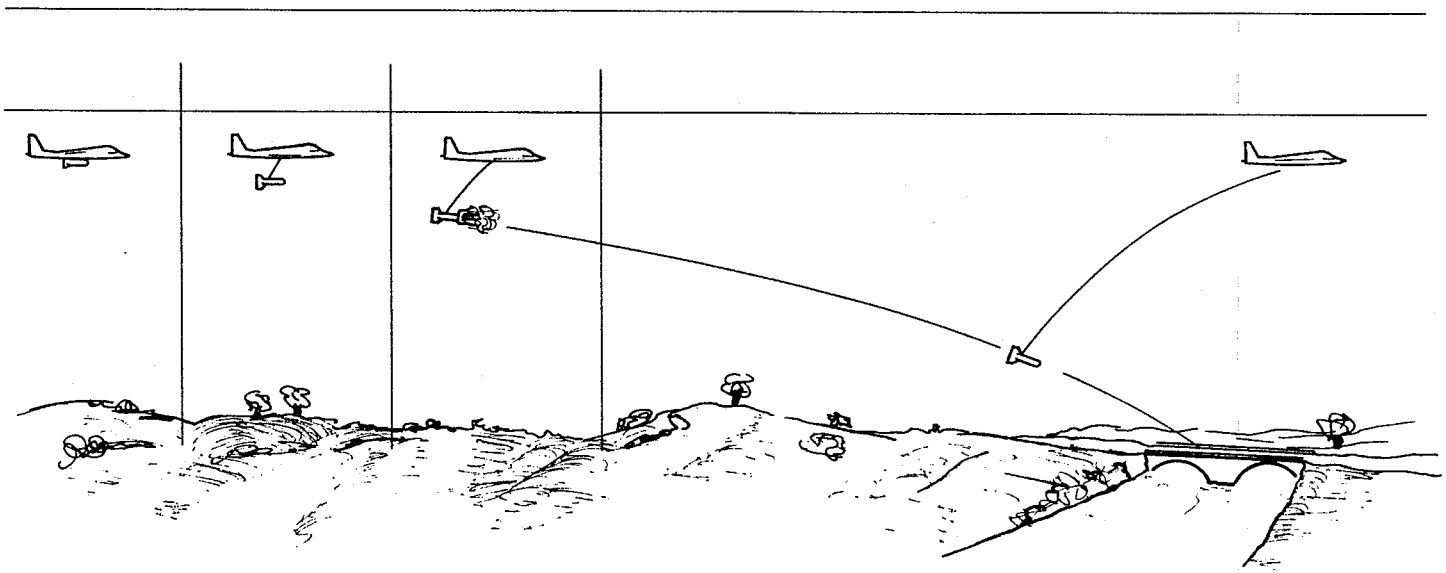
FIG. 2*a* is a view similar to FIG. 1*a* showing another embodiment of the invention.

FIGS. 2*a*, 2*b* and 2*c* show a variation which differs from the first version primarily in that a mechanical connection 30 between aircraft 20 and bomb 10 is provided as an information conveyor. Since all other physical devices are identical, the reference symbols from FIG. 1 have been used in FIG. 2. The laser illuminator 21 is not needed. A cable drum 31, 37, respectively, is mounted to the aircraft and/or missile, in which the mechanical connection is wound up.

The final phase guidance in this variation merely provides that, after the ignition of the retrorockets, the picture taken is transmitted from the target area into the aircraft via the connection 30 and is reproduced on the monitor. The bomb is then guided into the target in accordance with this information.

According to another variation, an electromagnetic connection is provided for the transmission of the pictorial information and guidance of the bomb. Either a conventional television camera or an infrared camera may be used as the picture-taking sensor.

While specific embodiments of the invention have been shown and described in detail to illustrate the application of the principles of the invention, it will be understood that the invention may be embodied otherwise without departing from such principles.

We claim:

1. A guided bomb for use in low level flying for pinpoint target combat, comprising, a bomb body, a braking device mounted on said body for producing a slowdown of said body effective against the trajectory thereof, and a picture-taking sensor on said bomb body connected to said bomb body and controlling the flight thereof for final phase guidance, and a mechanical connection for connecting said bomb to an aircraft and connected to said picture-taking sensor.

2. A guided bomb for use in low level flying for pinpoint target combat, comprising, a bomb body, a braking device mounted on said body for producing a slowdown of said body effective against the trajectory thereof, and a picture-taking sensor on said bomb body connected to said bomb body and controlling the flight thereof for final phase guidance, a laser illuminator associated with the bomb for illuminating a target and a tracker mounted on said bomb having laser vectoring.

* * * * *